US005723427A

United States Patent [19]

Scherr et al.

[11] Patent Number: 5,723,427

[45] Date of Patent: *Mar. 3, 1998

[54] GRANULAR DETERGENT COMPOSITIONS CONTAINING DEFLOCCULATING POLYMERS AND PROCESSES FOR THEIR PREPARATION

[75] Inventors: Elliot Michael Scherr, Princeton; Stephen Thomas Repinec, Jr., Flemington, both of N.J.

[73] Assignee: Colgate-Palmolive Company, New York, N.Y.

[ * ] Notice: The term of this patent shall not extend beyond the expiration date of Pat. No. 5,698,511.

[21] Appl. No.: 529,702

[22] Filed: Sep. 18, 1995

Related U.S. Application Data

[63] Continuation-in-part of Ser. No. 350,197, Dec. 5, 1994, abandoned.

[51] Int. Cl.[6] ..... C11D 3/37; C11D 11/02

[52] U.S. Cl. ..... 510/361; 510/351; 510/352; 510/452; 510/453; 510/475; 510/476

[58] Field of Search ..... 510/452, 453, 510/454, 475, 476, 533, 361, 434, 418, 351, 352

[56] References Cited

U.S. PATENT DOCUMENTS

| | | | |
|---|---|---|---|
| 3,308,067 | 3/1967 | Diehl | 510/346 |
| 3,922,230 | 11/1975 | Lamberti et al. | 510/476 |
| 5,147,576 | 9/1992 | Montague et al. | 510/417 |
| 5,489,397 | 2/1996 | Bainbridge | 510/337 |
| 5,599,784 | 2/1997 | Bainbridge | 510/417 |
| 5,602,092 | 2/1997 | Repinec, Jr. et al. | 510/434 |

FOREIGN PATENT DOCUMENTS

| | | |
|---|---|---|
| 0623670 | 11/1994 | European Pat. Off. . |
| 59-91184 | 5/1984 | Japan . |
| 310730 | 12/1989 | Japan . |
| 9109932 | 7/1991 | WIPO . |

OTHER PUBLICATIONS

PCT Search Report for PCT/US95/15591, May 3, 1996.

Derwent abstract accession No. 89–372253/51, for EP 346995, published Dec. 20, 1989, 1995.

Chemical Abstracts, vol. 101, No. 20, 12 Nov. 1984, Columbus, OH, US; abstract no. 173478u, ABE: "Sequestering Agents", p. 123, col. 1; XP002000806 & JP,A,59 091 184 (Yoshio Adeka Argus Chemical Co. Ltd) 25 May 1984.

Database WPI, Section Ch, Week 9005, Derwent Pubications Ltd., London, GB; Class B01, AN 90–033259 XP002000807 "Dispersant for use in Detergent . . . ", & JP,A,01 310 730 (Kao Corp), 14 Dec. 1989.

*Primary Examiner*—Ardith Hertzog

*Attorney, Agent, or Firm*—Bernard Lieberman; James M. Serafino

[57] ABSTRACT

The present invention provides for concentrated, granular detergent compositions comprising a mixture of:

a) from about 15 to about 50% by weight of a surfactant;

b) at least one detergent builder;

c) from about 0.01 to about 7.5% by weight of a deflocculating polymer composition containing polymer chains of the structure P-QR, wherein P represents a polymer chain segment of a hydrophilic polymer, and QR represents a hydrophobic end-cap group wherein R is an organic hydrophobic radical containing from about 4 to 28 carbon atoms, and Q is selected from the group consisting of O, $CO_2$, S, SO, $SO_2$, NR', $PO_4R'$, $PO_3R'$, Si OR'R", Si R'R", CR'OH, CR'R" and CR'OR" wherein R' and R" are each hydrogen, an alkyl group containing from 1 to 4 carbon atoms or an aryl group; and d) water.

The addition of the deflocculating polymer to a crutcher slurry prior to drying the slurry retards the propensity of the lamellar surfactant droplets dispersed in the slurry to flocculate, particularly where the droplets occupy a higher volume ratio as the result of high concentrations of surfactant present in the detergent.

The resultant slurry exhibits a significantly reduced viscosity which renders it more readily pumpable in a spray drying process.

33 Claims, No Drawings

GRANULAR DETERGENT COMPOSITIONS CONTAINING DEFLOCCULATING POLYMERS AND PROCESSES FOR THEIR PREPARATION

This application is a continuation-in-part of application Ser. No. 08/350,197 filed Dec. 5, 1994 now abandoned, the disclosure of which is incorporated herein by reference.

BACKGROUND OF THE INVENTION

1. Field of the Invention

This invention relates to granular detergent compositions containing an end-capped hydrophilic polymer as a crutcher slurry deflocculating agent.

2. Description of the Related Art

Heavy duty granular detergents useful for hand and machine washing of laundry are well known materials which have been described in a number of patents and in the literature. They are generally prepared by spray drying an aqueous based crutcher slurry containing at least one or a compatible mixture of two or more detergent active surfactants selected from anionic, cationic, nonionic, zwitterionic and amphoteric species. Such compositions may also contain detergency builder components and/or sequestering agents such as inorganic phosphates or phosphonates, alkali metal carbonates, alkali metal aminopolycarboxylates such as salts of nitrilotriacetic acid and salts of ethylenediaminetetraacetic acid, alkali metal silicates, aluminosilicates, various zeolites and mixtures of two or more of these. Other components which may be present in such detergents include optical brighteners, enzymes and their stabilizers, perfumes, colorants, antifoaming agents, e.g. silicone compounds, preservatives and like known additives.

One of the common methods for preparing powder detergents is to first form a pumpable aqueous slurry or dispersion of the detergent components, generally referred to as a crutcher slurry, and then atomizing the slurry by pumping it through an atomizing nozzle at a pressure of about 400 to 2000 psi into a spray-drying tower along with air introduced at a temperature of 300°–1000° F. The air contacts the slurry to provide a hot drying gas for the droplets of the slurry, thereby evaporating most of the water. The resulting particles or beads are collected at the bottom of the tower while the moisture and heated air exits at the top.

There is a trend in the detergent industry to provide powder detergent compositions having higher concentrations of active ingredients (payload), including surfactants. These include super concentrated, heavy duty detergent powder formulations containing greater than about 25% by weight of surfactant. While it may appear simple enough to provide such materials, there is a limiting factor in terms of the maximum quantity of surfactant which can be included in the crutcher slurry while still maintaining a slurry with sufficiently low viscosity such that it can be pumped to the spray dry tower, e.g. viscosity of about 500,000 or less.

The crutcher slurry generally may be characterized as composed of lamellar droplets dispersed in an aqueous electrolyte/builder phase. The lamellar droplets consist of an onion-like configuration of concentric bi-layers of surfactant molecules between which layers are trapped water or electrolyte solution. Such slurries may also contain suspended solids such as the suspended or dissolved builders referred to above. To facilitate spray drying, it is also preferred to have as high a level of non-aqueous solids in the crutcher slurry as possible, but without increasing the viscosity of the slurry to a point where it is non-pumpable. Also, as the level of surfactant in the crutcher slurry is increased, the volume fraction of lamellar droplets suspended is also increased, resulting in a diminished spacing between droplets. Contact of the suspended lamellar droplets with one another can lead to a congealing or flocculation phenomenon, resulting in a marked increase in the viscosity of the slurry due to formation of a network throughout the slurry. Slurries containing flocculated lamellar droplets and high solids levels may be unacceptable because of an inability to pump the viscous slurry from the mixing tank through the drying and granulation process. In addition, higher levels of surfactant induces the slurry to foam up under mixing conditions, requiring the addition of foam control agents such as silicones.

Concentrated liquid detergents containing a polymeric additive are disclosed in the prior art. The polymer serves to stabilize the detergent and control viscosity.

One approach to enhance the stability of such liquid detergent compositions is the inclusion of minor amounts, e.g., 0.01 to 5% by weight, of a deflocculating polymer into the detergent formulation. For example, U.S. Pat. No. 5,147,576 discloses random interpolymers derived from hydrophilic monomers, such as acrylic acid, and also containing one or more copolymerized monomers having pendant hydrophobic side chains randomly dispersed along the polymer chain. Use of these interpolymers in detergent compositions is disclosed to hinder or prevent flocculation of lamellar surfactant droplets dispersed in the detergent, and thus enhance stability. Granular detergent compositions containing similar deflocculating polymers are disclosed in WO/91/09932.

Hydrophilic polymeric materials have also been used in liquid detergent compositions as viscosity control agents. For example, U.S. Pat. No. 4,715,969 and its counterpart UK 2,168,717 disclose that the addition of less than about 0.5% by weight of a polyacrylate polymer, e.g. sodium polyacrylate, having a molecular weight from about 1,000 to 5,000, to aqueous detergent compositions containing primarily anionic surfactants will stabilize the viscosity of the composition and prevent a major increase in viscosity after a period of storage of the formulated composition. Also, EPO 301,883 discloses similar compositions containing from about 0.1 to 20% by weight of a viscosity reducing, water soluble polymer such as polyethylene glycol, dextran or a dextran sulfonate.

Polymeric additives have also been used in powder detergents. For example, Canadian Patent 1,174,934 discloses granular detergents containing surfactant, crystalline aluminosilicate and alkaline salt builders, and from about 0.1 to 10% by weight of a film forming, water soluble acidic polymer such as acrylic or sulfate functional polymers. The polymers are said to provide dried granules having superior free-flowing characteristics and good solubility in water. Also, U.S. Pat. No. 3,308,067 discloses a granular detergents containing a water soluble salt of a homopolymer of an aliphatic polycarboxylic acid as a polyelectrolytic builder material.

U.S. Pat. Nos. 3,668,230; 3,839,405; 3,772,382; and 3,776,874 issued to Uniroyal, Inc. disclose alkyl sulfide, alkyl sulfoxide and alkyl sulfone terminated oligomers for use in emulsion polymerization. The oligomers are broadly stated to be useful as surface active agents, emulsifiers and thickeners.

EP 623670A describes the use of stabilizers in an aqueous surfactant composition to reduce the flocculation of systems containing a flocculable surfactant. The stabilizers are described as surfactants having a hydrophobic portion and a hydrophilic portion. The hydrophilic portion is typically a polymer linked at one end to the hydrophobic portion.

SUMMARY OF THE INVENTION

The present invention provides for concentrated granular detergent compositions comprising a mixture of:

a) from about 15 to about 50% by weight of a surfactant;

b) at least one detergent builder; and c) from about 0.01 to about 7.5% by weight of a deflocculating polymer composition containing polymer chains of the structure P-QR, wherein P represents a polymer chain segment of a hydrophilic polymer, and QR represents a hydrophobic end-cap group wherein R is an organic hydrophobic radical containing from about 4 to 28 carbon atoms, and Q is selected from the group consisting of O, $CO_2$, S, SO, $SO_2$, NR', $PO_4R'$, $PO_3R'$, Si OR'R", Si R'R", CR'OH, CR'R" and CR'OR" wherein R' and R" are each hydrogen, an alkyl group containing from 1 to 4 carbon atoms or an aryl group; and d) water The granular detergent is prepared by drying a crutcher slurry comprising an aqueous dispersion of the organic surfactant, detergent builder, deflocculating polymer and other ingredients which may be present in the composition. The presence of the deflocculating polymer in the slurry retards the propensity of the lamellar droplets dispersed in the aqueous electrolytic phase of the slurry to flocculate, particularly where the droplets occupy a higher volume ratio as the result of high concentrations of surfactant present in the detergent. The resulting slurry has a much lower viscosity than a similar slurry which does not contain the deflocculating polymer, and is thus more flowable and more easily pumped to and through the drying stage of the manufacturing process.

DETAILED DESCRIPTION OF THE INVENTION

The granular compositions of the invention contain one or a compatible mixture of two or more detergent active surfactants which may be selected from anionic, cationic nonionic, zwitterionic and amphoteric species.

Suitable anionic detergents include the water-soluble alkali metal salts having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced, for example, from tallow or coconut oil; sodium and potassium alkyl ($C_9$–$C_{20}$) benzene sulfonates, particularly sodium linear secondary alkyl ($C_{10}$–$C_{15}$) benzene sulfonates; sodium alkyl glycerol ether sulfates, especially those ethers of the higher alcohols derived from tallow or coconut oil and synthetic alcohols derived from petroleum; sodium coconut oil fatty monoglyceride sulfates and sulfonates; sodium and potassium salts of sulfuric acid esters of higher ($C_8$–$C_{18}$) fatty alcohol-alkylene oxide, particularly ethylene oxide reaction products; the reaction products of fatty acids such as coconut fatty acids esterified with isethionic acid and neutralized with sodium hydroxide; sodium and potassium salts of fatty acid amides of methyl taurine; alkane monosulfonates such as those derived from reacting alpha-olefins ($C_8$–$C_{20}$) with sodium bisulfite and those derived from reacting paraffins with $SO_2$ and $Cl_2$ and then hydrolyzing with a base to produce a random sulfonate; and olefin sulfonates which term is used to describe the material made by reacting olefins, particularly $C_{10}$–$C_{20}$ alpha-olefins, with $SO_3$ and then neutralizing and hydrolyzing the reaction product. The preferred anionic detergents are sodium ($C_{10}$–$C_{16}$) linear alkyl benzene sulfonates, ($C_{10}$–$C_{18}$) alkyl polyethoxy sulfates and mixtures thereof.

The more preferred anionic detergent is one or a mixture of linear or branched (preferably linear) higher alkylbenzene sulfonate and alkyl polyethoxy sulfates. While other water soluble linear higher alkylbenzene sulfonates may also be present in the formulas of the present invention, such as potassium salts and in some instances the ammonium and/or alkanolammonium salts, where appropriate, it has been found that the sodium salt is highly preferred, which is also the case with respect to the alkyl polyethoxy sulfate detergent component. The alkylbenzene sulfonate is one wherein the higher alkyl group is of 10 to 16 carbon atoms, preferably 12 to 15, more preferably 12 to 13 carbon atoms. The alkyl polyethoxy sulfate, which also may be referred to as a sulfated polyethoxylated higher linear alcohol or the sulfated condensation product of a higher fatty alcohol and ethylene oxide or polyethylene glycol, is one wherein the alkyl group is of 10 to 18 carbon atoms, preferably 12 to 15 carbon atoms, and which includes 2 to 11 ethylene oxide groups, preferably 2 to 7, more preferably 3 to 5 and most preferably about 3 ethylene oxide groups.

The anionic detergent may be present in the granular detergent at a level of from about 15 to about 50% by weight, more preferably from about 20 to about 45% by weight. Where mixtures of two or more different anionic detergents are used, such as the sulfate and sulfonate mixtures described above, they may be mixed in the relative proportions in the range of about 5 to 95% by weight of each type.

The composition of this invention may also contain supplementary nonionic and amphoteric surfactants. Suitable nonionic surfactants include, in particular, the reaction products of compounds having a hydrophobic group and a reactive hydrogen atom, for example aliphatic alcohols, acids, amides and alkyl phenols with alkylene oxides, especially ethylene oxide, either alone or with propylene oxide. Specific nonionic detergent compounds are alkyl ($C_6$–$C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long-chain tertiary phosphine oxides, dialkyl sulfoxides, fatty ($C_8$–$C_{18}$) esters of glycerol, sorbitan and the like, alkyl polyglycosides, ethoxylated glycerol esters, ethoxylated sorbitans and ethoxylated phosphate esters.

The preferred non-ionic detergent compounds are those of the ethoxylated and mixed ethoxylated-propyloxylated ($C_6$–$C_{18}$)fatty alcohol type. The nonionic surfactants may be present in the composition at a preferred level of from about 1 to 15% by weight.

It is also possible to include an alkali metal soap of a mono- or di-carboxylic acid, especially a soap of an acid having from 12 to 18 carbon atoms, for example oleic acid, ricinoleic acid, alk(en)yl succinate, for example dodecenyl succinate, and fatty acids derived from castor oil, rapeseed oil, groundnut oil, coconut oil, palmkernel oil or mixtures thereof. The sodium or potassium soaps of these acids can be used. When used, the level of soap in compositions of the invention is from about 0.5 to 15% by weight of the composition.

Particularly preferred combinations of surfactants include:

1. A mixture which comprises about 15 to 30% by wt. linear alkylbenzene sulfonate wherein the alkyl group contains from about 10 to 16 carbon atoms and about 1 to 10% by wt. of alkyl polyethoxy sulfate wherein the alkyl is of 10 to 18 carbon atoms and the polyethoxy is of 2 to 7 ethylene oxide groups.

2. A mixture which comprises one or both of the anionic surfactants listed in 1 above and a nonionic ethoxylated fatty alcohol wherein the fatty alcohol is of 8 to 18 carbon atoms and the polyethoxy is of 2 to 7 oxide groups. The anionic to nonionic surfactant ratio is from about 1:4 to 10:1.

A more detailed illustration of the various detergents and classes of detergents mentioned may be found in the text *Surface Active Agents,* Vol. II, by Schwartz, Perry and Berch (Interscience Publishers, 1958), in a series of annual publications entitled *McCutcheon's Detergents and Emulsifiers,* issued in 1969, or in *Tensid-Taschenbuch,* H. Stache, 2nd Edn. Carl Hanser Verlag, Munich and Vienna, 1981.

The composition of this invention also includes at least one detergency builder. Suitable builders include phosphorous-containing inorganic salts, organic builders and non-phosphorous-containing builders. The prime function of the builder is to complex with hard water cations which form salts insoluble in water, for example calcium and magnesium cations, through the mechanism of sequestration or cation exchange.

Examples of phosphorous-containing inorganic detergency builders include the water-soluble salts, especially alkali metalpyrophosphates, orthophosphates, polyphosphates and phosphonates. Specific examples of inorganic phosphate builders include sodium and potassium tripolyphosphates, phosphates and hexametaphosphates. Phosphonate sequestrant builders may also be used. Examples of organic detergency builders which may be used include the alkali metal, ammonium and substituted ammonium polyacetates, carboxylates, polycarboxylates, polyacetyl carboxylates and polyhydroxysulphonates. Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids, tartrate mono succinate, tartrate di succinate, alk(en)yl succinates and citric acid. Other organic detergency builders include water-soluble alkali metal carbonates and bicarbonates, as well as mixtures thereof with phosphates, e.g., a mixture of sodium carbonate and sodium tripolyphosphate.

Builders other than phosphorous-containing compounds may also be used. Preferred builders for use in phosphorous-free compositions include cation-exchanged amorphous or crystalline aluminosilicates of natural or synthetic origin. Suitable aluminosilicate zeolites include "zeolite A", "zeolite B", "zeolite X", "zeolite Y" and "zeolite HS". The more preferred zeolite is crystalline sodium silicoaluminate zeolite A. Preferably, the zeolite should be in a finely divided state with the ultimate particle diameters being up to 20 microns, e.g., 0.005 to 20 microns, preferably from 0.01 to 15 microns and more preferably of 0.01 to 8 microns mean particle size, e.g. 3 to 7 microns, if crystalline, and 0.01 to 0.1 microns if amorphous. Although the ultimate particle sizes are much lower, usually the zeolite particles will be of sizes within the range of 100 to 400 mesh, preferably 140 to 325 mesh. Zeolites of smaller sizes will often become objectionably dusty and those of larger sizes may not be sufficiently and satisfactorily suspended in the crutcher slurry.

In another embodiment of the invention where phosphorous-free builders are used, the builder may comprise water soluble non-phosphorous containing compounds which dissolve in the aqueous phase of the crutcher slurry forming an electrolyte solution. Examples of such builders include the alkali metal carboxylates referred to above, e.g., sodium citrate, used alone or in a mixture with water soluble alkali metal carbonates or bicarbonates, e.g., sodium or potassium carbonate.

Mixtures containing two or more of the above described detergency builders may also be employed. The builder or mixture of builders may be present in the granular detergent in the range of from about 15 to about 60% by weight of the composition, more preferably from about 20 to about 50% by weight. Where the builder is a zeolite material, it is normally present in the range of from about 5 to 30% by weight of the composition, and is preferably used in combination with other compatible builder materials.

The granular detergent also preferably contains one or a mixture of alkali metal silicates which function to form a tough, glassy film capable of strengthening granule walls and imparting better flow characteristics to the dried detergent granules. Preferred silicates are those having an $SiO_2$ to alkali metal oxide ratio of 1.5 to 2.0 since these tend to be more water soluble. Sodium silicate is the preferred silicate. The silicate may be present in the detergent granules at a level of from about 3 to about 40% by weight, more preferably from about 5 to about 35% by weight. The key ingredient in the compositions of the present invention is the hydrophobically modified deflocculating polymer which both stabilizes the crutcher slurry and decreases its viscosity. The hydrophobic end groups present in the otherwise hydrophilic polymer become enveloped in the lamellar droplets formed by the surfactant phase of the slurry, thereby both sterically and electrostatically inhibiting flocculation of these droplets, even at relatively high concentrations. This results in a stable, lower viscosity, pumpable slurry.

Deflocculating polymers useful in accordance with this invention are characterized as comprising a hydrophilic polymer chain segment (P) having a hydrophobic moiety (QR) covalently attached to a terminal carbon atom present in at least some of the hydrophilic chain segments. These polymers may be generally characterized as containing the structure P-QR wherein P represents the hydrophilic polymer and R is an organic hydrophobic radical containing from about 4 to 28 carbon atoms, more preferably an alkyl radical containing from about 6 to 18 carbon atoms.

Q represents a group or molecule which is capable of linking the hydrophilic polymer P with the organic hydrophobic radical R and thereby acts as a polymer chain terminator (or initiator). In general, Q may be selected from the group consisting of O, $CO_2$, S, SO, $SO_2$, NR', $PO_4R'$, $PO_3R'$, Si OR'R", Si R'R", CR'OH, CR'R", and CR'OR" wherein R' and R" are each hydrogen, an akyl group containing 1 to 4 carbon atoms or an aryl group. R is a $C_4$–$C_{28}$ alkyl, alkenyl or aralkyl group, preferably an alkyl or aralkyl group containing 6 to 18 carbon atoms. The preferred polymers of the invention are terminated with an alkyl sulfide, alkyl-sulfoxide or alkyl-sulfone end-cap group.

Monomers which may be polymerized to form the hydrophilic polymer segment include one or a mixture of water soluble monomers or a combination of water soluble and relatively water insoluble monomers such that the resulting polymers are water soluble at ambient temperatures to the extent of greater than about 10 grams per liter. Examples of suitable such monomers include ethylenically unsaturated amides such as acrylamide, methacrylamide and fumaramide and their N-substituted derivatives such as 2-acrylamido-2-methylpropane sulfonic acid, N-(dimethylaminomethyl) acrylamide as well as N-(trimethylammoniummethyl) acrylamide chloride and N-(trimethylammoniumpropyl) methacrylamide chloride; ethylenically unsaturated carboxylic acids or dicarboxylic acids such as acrylic acid, maleic acid, methacrylic acid, itaconic acid, fumaric acid, crotonic acid, aconitic acid and citraconic acid; and other ethylenically unsaturated quaternary ammonium compounds such as vinyl-benzyl trimethyl ammonium chloride; sulfoalkyl esters of unsaturated carboxylic acids such as 2-sulfoethyl methacrylate; aminoalkyl esters of unsaturated carboxylic acids such as 2-aminoethyl methacrylate, dimethyl aminoethyl (meth)acrylate, diethyl aminoethyl (meth)acrylate, dimethyl aminomethyl (meth) acrylate, diethyl aminomethyl (meth)acrylate, and their quaternary ammonium salts; vinyl or allyl amines such as vinyl pyridine and vinyl morpholine or allylamine; diallyl amines and diallyl ammonium compounds such as diallyl dimethyl ammonium chloride; vinyl heterocyclic amides such as vinyl pyrrolidone; vinyl aryl sulfonates such as vinylbenzyl sulfonate; vinyl alcohol obtained by the hydrolysis of vinyl acetate; acrolein; allyl alcohol; vinyl acetic acid; sodium vinyl sulphonate; sodium allyl sulphonate, as well as the salts of the foregoing monomers. These monomers may be used singly or as mixtures thereof.

Optionally, the hydrophilic polymer segment may contain small amounts of relatively hydrophobic units, e.g., those derived from polymers having a solubility of less than 1 g/l in water, provided that the overall solubility of the hydrophilic polymer still satisfies the solubility requirements as specified above. Examples of relatively water insoluble polymers are polyvinyl acetate, polymethyl methacrylate, polyethyl acrylate, polyethylene, polypropylene, polystyrene, polybutylene oxide, polypropylene oxide and polyhydroxypropyl acrylate.

A particular class of preferred alkyl sulfide terminated polymers in accordance with the invention may be represented by the following structural formula:

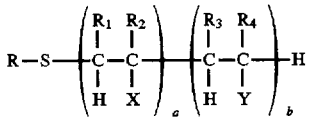

where R is a straight or branched chain primary, secondary, or tertiary alkyl group having 5 to 20 carbon atoms; $R_1$ and $R_3$ are each hydrogen, methyl, ethyl, or —COOH; $R_2$ and $R_4$ are each hydrogen, methyl, ethyl, —COOH, or —$CH_2COOH$; Y is selected from the group consisting of —COOH, —$CONH_2$, —$OCH_3$, —$OC_2H_5$, and —$CH_2OH$; X is selected from the group consisting of —$COOC_2H_4OH$, —$COOC_3H_6OH$, —$CONHCH_2OH$, —$CONHCH_3$, $CONHC_2H_5$, —$CONHC_3H_7$, —$COOCH_3$, —$COOC_2H_5$, —CN, —$OOCCH_3$, —$OOCC_2H_5$, and —$COOCH_3CHOCH_2$.

The degree of polymerization, a+b, is generally between 2 and 50, and the mole fraction of the monomer having the X functional group, a/(a+b), may vary from 0 to 0.6, and is preferably less than 0.5 and most preferably is 0.2 to 0.5. The presence of a monomer having the X functional group is optional hence the value of "a" will be zero for polymers containing only monomers having a Y functional group. A comprehensive description of these alkyl sulfide terminated polymers and their method of preparation is disclosed in U.S. Pat. No. 3,839,405, the complete disclosure of which is incorporated herein by reference.

Particularly preferred polymers for use herein comprise a hydrophilic polymer terminated by a hydrophobic mercapto end-cap group derived from a mercaptan having the structure RSH, where R is an alkyl or aralkyl radical having 4 to 28 carbon atoms. R should be of sufficient chain length such that it exhibits oleophilic properties, i.e., it is miscible with the oily lamellar droplet or micelle phase of the detergent composition. Preferably, the mercaptans are alkyl or aralkyl mercaptans containing about 6 to 18 carbon atoms such as hexyl mercaptan, decyl mercaptan, dodecylbenzyl mercaptan, dodecyl mercaptan and octadecyl mercaptan.

The hydrophilic polymer backbone may also be advantageously chain terminated with a sulfoxide or a sulfone group. A class of preferred polymers for use herein may be represented by the following structural formula:

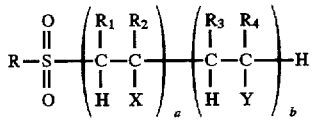

wherein R, $R_1$, $R_2$, $R_3$, $R_4$, X, Y, the degree of polymerization a+b, and the mole fraction a/(a+b) are as defined above; Z is either oxygen or not present. When Z is oxygen the end-cap group is an alkyl sulfone; when Z is not present the end-cap group is an alkyl sulfoxide. A comprehensive description of these type alkyl-sulfoxide and alkyl-sulfone terminated polymers and their method of preparation is disclosed in U.S. Pat. Nos. 3,772,382; 3,776,874; and 3,668,230, the complete disclosures of which are incorporated herein by reference.

By example, mercapto terminated polymers may be prepared by free radical polymerization of the hydrophilic monomer or monomer mixture in an aqueous or water/alcohol medium in the presence of a water soluble free radical initiator and in the presence of an RSH mercaptan. The molar ratio of monomer to mercaptan may generally range from about 10:1 to about 150:1 respectively, more preferably from about 25:1 to about 100:1 respectively. Under free radical polymerization conditions, a number of RS free radicals will be generated which may serve to initiate polymerization of additional monomer or these radicals can couple with a growing polymer chain, resulting in a mixed polymer product wherein at least some of the chains have the structure P-QR as described above. The number of P and P-QR chains present in the mixed polymer product will vary depending on polymerization conditions, average molecular weight of the polymer and the quantity of mercaptan present in the polymerization mixture. Preferably from about 25 up to about 95% of the polymer chains are end-capped by the SR mercapto hydrophobe.

Polymerization may be conducted by the general procedures described in U.S. Pat. No. 5,021,525, the complete disclosure of which is incorporated herein by reference. The preferred aqueous polymerization medium comprises a mixture of at least 50% by weight of water and miscible cosolvent such as a $C_1$ to $C_4$ alcohol, e.g., isopropanol, which tends to retard precipitation of the developing end-capped polymer from solution. Polymerization initiators which may be used include water soluble initiators such as hydrogen peroxide, persulfates, perborates and permanganates, present in solution at levels generally in the range of from about 0.1 to 5% by weight.

Polymerization may be conducted by initially charging an initiator, e.g. sodium persulfate, into an aqueous polymerization medium, followed by gradual introduction of a mixture comprising monomer and mercaptan into the medium at a level of from about 10 to 55% by weight of total reactants, and heating the mixture at a temperature in the range of from about 70° to 99° C. for a period of time sufficient to form polymer of the desired molecular weight, generally from about 3 to 6 hours. Preferably, only a portion of the monomer and initiator is added to the medium initially, followed by the addition of remaining monomer and initiator later during the polymerization. The polymer may then be recovered by stripping the cosolvent, e.g., isopropanol and at least part of the water, followed by neutralization of the polymer with caustic, e.g., sodium hydroxide.

Preferred deflocculating polymers useful for the purposes of this invention have a weight average molecular weight, as measured by gel permeation chromatography using polyacrylate standards, in the range of from about 200 to 50,000, more preferably from about 200 to 25,000 and most preferably for polymers based on polyacrylic and polymethacrylic acid, from about 3,000 to 10,000. The most preferred polymers are hydrophilic homopolymers such as polyacrylic or polymethacrylic acid and copolymers of acrylic or methacrylic acid with less than 50 wt % of maleic acid (anhydride), wherein the bulk of the polymer chains are end-capped with a single hydrophobic segment derived from dodecyl mercaptan.

The deflocculating polymer is generally added to the formulation at levels such that the content of the polymer in the final spray dried granular product ranges from about 0.01 to about 7.5% by weight, more preferably from about 0.5 to about 5% by weight, and most preferably from about 1 to about 3% by weight.

These polymers and their method of preparation are further disclosed in copending U.S. application Ser. No. 08/212,611, filed on Mar. 14, 1994, the complete disclosure of which is incorporated herein by reference.

The aqueous phase of the crutcher slurry is electrolytic and thus contains a water soluble salt. Where the builder present in the detergent is itself a water soluble salt, e.g., where the builder is an alkali metal carbonate phosphate or citrate, no additional electrolyte need be added. Where the builder is water insoluble, e.g., a zeolite, then alkali metal halides or sulfates may be included as necessary to form the aqueous electrolyte solution.

The granular detergent composition is prepared by drying a crutcher slurry comprising an aqueous dispersion of the above components. The slurry generally contains from about 25 to 65% by weight water more preferably 35 to 50% by weight water, some of which is present as a diluent in some formulation components, e.g., surfactants, and some of which is added when the slurry is prepared. After drying, the detergent granules generally contain 15% by weight water or less, generally from 2 to 15%, by weight, water and preferably from 2 to 10% by weight.

Various adjuvants, both aesthetic and functional, may be present in the detergent compositions of the present invention, such as fluorescent brighteners, perfumes and colorants. The fluorescent brighteners include the well known stilbene derivatives, including the cotton and nylon brighteners, such as those sold under the trademark Tinopal©, e.g. 5 BM. The perfumes that are employed usually include essential oils, esters, aldehydes and/or alcohols, all of which are known in the perfumery art. The colorants may include dyes and water dispersible pigments of various types, including ultramarine blue. Titanium dioxide may be utilized to lighten the color of the product further or to whiten it. Inorganic filler salts, such as sodium sulfate and sodium chloride may be present, as may be antiredeposition agents, such as sodium carboxymethylcellulose; enzymes, such as proteases, amylases and lipases; bleaches, such as sodium perborate or percarbonate or chlorine-containing materials; bactericides; fungicides; anti-foam agents, such as silicones; antisoiling agents, such as copolyesters; preservatives, such as formalin; foam stabilizers, such as lauric myristic diethanolamide; and auxiliary solvents, such as ethanol. Normally the individual proportions of such adjuvants will be less than 3%, often less than 1% and sometimes even less than 0.5%, except for any fillers and solvents, and additional detergents and builders, for which the proportions may sometimes be as high as 10%. The total proportion of adjuvants, including non-designated synthetic detergents and builders, will normally be no more than 20% of the product and desirably will be less than 10% thereof, more desirably less than 5% thereof. Of course, the adjuvants employed will be non-interfering with the washing and the softening actions of the detergent and will not promote instability of the product on standing. Also, they will not cause the production of objectionable deposits on the laundry.

These adjuvants are most preferably mixed with the finished granular detergent after the drying operation.

The viscosity of the crutcher slurry composition immediately after completion of the slurry mixing procedure will vary depending on the solids content of the slurry and the amount of deflocculating polymer present in the slurry. For slurries containing relatively low solids level, e.g. 35 to 50% by weight solids, the viscosity will range from about 2,000 to 100,000 cps. For slurries containing higher solids levels, e.g. 50–65% by weight, the viscosity will range from about 100,000 to 500,000 cps, as measured using a Brookfield Viscosimeter Model LVT-II at an angular velocity of 12 rpm and at 25° C. Spindle No. 3 is used to measure viscosities below 10,000 cps and spindle No. 4 is used for viscosities above 10,000 cps. The more preferred viscosity will be in the range of from about 100,000 to 500,000 cps, most preferably in the range of about 200,000 to 400,000 cps. The pH of the slurry will generally be in the range of from about 7 to about 12, preferably 10 to 12, and pH may be adjusted if necessary by adding to the slurry appropriate amounts of a basic solution such as 50% KOH.

The components of the crutcher slurry may be mixed in any suitable order which will lead to the development of a uniform dispersion. In a preferred procedure, water and all of the liquids (silicate, surfactant, and polymer) are mixed first with high shear mixing in the crutcher. If the formula contains phosphate builder, it is added next; there is a delay step while the phosphate hydrates. Subsequent solids then added include soda ash, zeolite (if no phosphate), sodium sulfate, brightener, and salt. The silicone defoamer is added last to dearate the slurry just prior to it being dropped out of the crutcher to a drop tank where it will be pumped to the spray tower. The crutcher slurry will generally have a final solids content of about 40–75% by weight, more preferably from about 50 to 70% by weight.

The slurry may then be dried using any of the well known drying processes such as spray drying, fluid bed drying, flash drying, microwave drying and the like. The preferred process is the spray dry process. In a typical spray dry process, the crutcher slurry is atomized by pumping it into an atomizing nozzle of a spray dry tower at a pressure which may range from about 400 to 2,000 psi. Typical dimensions of a spray dry tower range from 35–100 feet in height and 12–30 feet in diameter. At the base of the tower, air is introduced at a temperature of from about 300°–1000° F. which contacts the atomized slurry to provide a hot drying gas for the droplets of the slurry, thereby evaporating most of the water. The resulting dried granules are collected at the tower base and cooled. Heat or water-sensitive ingredients such as perfumes may be post added to the tower granules in a subsequent mixing or blending operation.

The following examples are illustrative of the invention.

EXAMPLE 1

The following ingredients in parts by weight (grams) were mixed in the order shown in laboratory beaker using a high speed propeller mixer to form a pumpable crutcher slurry:

| | |
|---|---|
| Water | 11.5 |
| Anionic Surfactant (LDBS)* | 60.0 |
| Deflocculating Polymer** | 5.4 |
| Potassium Tripolyphosphate | 39.0 |
| Sodium Silicate Solution | 17.0 |

*Linear alkylbenzene sulfonate detergent containing 10–14 carbon atoms.
**Copolymer of acrylic and maleic acids endcapped with dodecyl mercaptan and having a weight average molecular weight of about 10,000 and about a 50:1 mole ratio of hydrophile to dodecyl hydrophobe.

Mixing time was approximately 30 minutes. The resulting slurry had a viscosity of 8,000±1,000 cps measured using a Brookfield #3 spindle at 12 RPM, and was readily flowable and pumpable as required for subsequent spray drying to produce a granular detergent.

CONTROL EXAMPLE 2

Example 1 was repeated as set forth above except that the deflocculating polymer was omitted from the formulation and replaced with an equal amount of sodium polyacrylate polymer having a molecular weight of about 4500. The resulting formulation was found to have a viscosity in excess of 50,000 cps, could not be poured from the beaker and thus could not be pumped to or through a spray dry tower.

EXAMPLE 3

The ingredients listed below (in grams) were mixed as in Example 1 for a period of about 15 minutes to form crutcher slurries having a non-aqueous solids content of about 56%:

| | EX 3 | CONTROL |
|---|---|---|
| Water | 119 | 119 |
| LDBS | 408 | 408 |
| Sodium Silicate | 112 | 112 |
| Deflocculating Polymer* | 2 | — |
| Control Polymer** | — | 2 |
| Sodium Hydroxide | 50 | 50 |
| Potassium Tripolyphosphate | 256 | 256 |
| Sodium Sulfate | 14 | 14 |
| Viscosity | 235,000 | 900,000 |

*Copolymer of acrylic and maleic acids endcapped with dodecyl mercaptan and having a weight average molecular weight of about 4000 and about a 25:1 mole ratio of hydrophile to dodecyl hydrophobe.
**Acrylic homopolymer having a weight average molecular weight of about 4500.

The viscosity of the resultant slurry of Example 3 was measured as 235,000 cps using a Brookfield DV-11 viscometer equipped with a helipath stand; the control slurry had a viscosity of 900,000 cps and was too thick to be pumpable in a spray dry process.

EXAMPLES 4–6

Example 3 was repeated except that the water content of the slurry formulation was lowered to provide solids contents of 61, 63 and 65% by weight respectively. Viscosity data for each slurry was obtained as in Example 3 with the following results:

| | % SOLIDS | VISCOSITY (cps) |
|---|---|---|
| Ex. 4 | 61 | 220,000 |
| Ex. 5 | 63 | 518,000 |
| Ex. 6 | 65 | 1,500,000 |

The above data demonstrate that formulations containing 2% by weight of defocculating polymer and a solids level up to and greater than about 63% by weight exhibit viscosities lower than the control formulation at a solids level of only 59% by weight.

EXAMPLE 7

Slurries were prepared as set forth in Example 3 using the same deflocculating polymer and control polymer as described in Example 3. The slurries were then spray dried under the conditions described below. The crutcher slurry and post-spray dried finished product compositions are as set forth in Table 1.

TABLE 1

| | Example 7 | | Control Example | |
|---|---|---|---|---|
| Ingredient | Crutcher % | Finished Product | Crutcher % | Finished Product % |
| Water | 0.2 | 8 | 13.9 | 8 |
| Sodium Sulfate | 5.5 | 7.6 | 4.8 | 7.6 |
| LDBS | 46.16 | 28 | 40.1 | 28 |
| Brightener | 0.096 | 0.12 | 0.08 | 0.012 |
| Silicate | 12.7 | 7.5 | 11.0 | 7.5 |
| TPP | 29 | 36 | 25.2 | 36 |
| NaCl | 1.6 | 2 | 1.4 | 2 |
| Deflocc. Polymer | 4.6 | 2 | — | — |
| Control Polymer | — | — | 3.5 | 2 |
| Silicone | 0.02 | 0.03 | 0.02 | 0.03 |

Spray Conditions were as follows:

| | Deflocculating Polymer | Control |
|---|---|---|
| Air flow (CFM) | 3200 | 3200 |
| Spray Pressure (PSI) | 1100–1250 | 1250 |

cfm = cubic feet per minute
psi = pounds per square inch

| PROPERTIES | Ex. 7 | CONTROL |
|---|---|---|
| Density of Finished Product Powder | 0.32 | 0.52 |
| % Solids in Crutcher Slurry | 66.5% | 58% |
| Slurry Viscosity (cps) | 239,900 | 361,000 |

The formulation of Example 7 has a considerably lower viscosity than the control even though the slurry solids level is over 8% higher than the Control. Also, the density of the spray dried product of Example 7 was considerably lower than that of the Control.

What is claimed is:

1. A concentrated granular detergent composition containing about 15% by weight water or less comprising a mixture of:

a) from about 15 to 50% by weight of surfactant;

b) at least one detergent builder;

c) from about 0.01 to about 7.5% by weight of a deflocculating polymer containing polymer chains of the structure P-QR, wherein P represents a polymer chain segment of a hydrophilic polymer, and QR represents a hydrophobic end-cap group wherein R is an organic hydrophobic radical containing from about 4 to 28 carbon atoms, and Q is S; and d) water.

2. The composition of claim 1 wherein said surfactant comprises at least one anionic detergent which is an anionic sulfate or sulfonate.

3. The composition of claim 2 containing from about 15 to 30% by weight of an alkyl benzene sulfonate anionic detergent having from about 10 to 16 alkyl carbon atoms.

4. The composition of claim 2 containing from about 1 to about 10% by weight of a sodium or potassium alkyl polyethoxy sulfate anionic detergent wherein the alkyl group contains from about 10 to 18 carbon atoms and the polyethoxy is of 2 to 7 ethylene oxide groups.

5. The composition of claim 3 wherein said surfactant comprises a mixture of said alkyl benzene sulfonate and from about 1 to about 10% by weight of a sodium or potassium alkyl polyethoxy sulfate wherein the alkyl group contains from about 10 to 18 carbon atoms and the polyethoxy is of 2 to 7 ethylene oxide groups.

6. The composition of claim 3 or 5 further containing from about 1 to 15% by weight of a nonionic ethoxylated fatty alcohol wherein the fatty alcohol contains about 6 to 18 carbon atoms.

7. The composition of claim 1 wherein the hydrophilic polymer chain segment P is polyacrylic or polymethacrylic acid.

8. The composition of claim 1 wherein the hydrophilic polymer chain segment P is a copolymer containing at least 50% by weight of polymerized acrylic or methacrylic acid and less than 50% by weight of polymerized maleic acid or maleic anhydride.

9. The composition of claim 1 wherein said polymer has a weight average molecular weight in the range of from about 2,000 to 25,000.

10. The composition of claim 9 wherein said polymer has a weight average molecular weight in the range of from about 3,000 to 10,000.

11. The composition of claim 1 wherein R is an alkyl group containing from about 6 to 18 carbon atoms.

12. The composition of claim 11 wherein R is dodecyl.

13. The composition of claim 1 wherein from about 25 to 95% by weight of the hydrophilic polymer chains present in said deflocculating polymer have said structure P-QR.

14. The composition of claim 1 wherein said deflocculating polymer is an alkyl sulfide terminated polymer represented by the following structural formula:

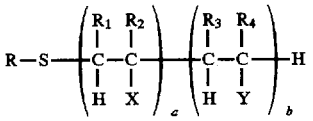

wherein R is a straight or branched chain primary, secondary, or tertiary alkyl group having 5 to 20 carbon atoms; $R_1$ and $R_3$ are each hydrogen, methyl, ethyl, or —COOH; $R_2$ and $R_4$ are each hydrogen, methyl, ethyl, —COOH, or $CH_2COOH$; Y is selected from the group consisting of —COOH, $—CONH_2$, $—OCH_3$, $—OC_2H_5$, and $—CH_2OH$; X is selected from the group consisting of $—COOC_2H_4OH$, $—COOC_3H_6OH$, $—CONHCH_2OH$, $—CONHCH_3$, $—CONHC_2H_5$, $—CONHC_3H_7$, $—COOCH_3$, $—COOC_2H_5$, —CN, $—OOCCH_3$, $—OOCC_2H_5$, and $—COOCH_3CHOCH_2$; the degree of polymerization, a+b, is from 2 to 50, and the mole fraction of the monomer having the X functional group, a/(a+b) is from 0 to 0.6.

15. The composition of claim 1 wherein said detergent builder is present in said composition at a level of from about 15 to 60% by weight of said composition.

16. The composition of claim 15 wherein said detergent builder comprises one or more phosphates.

17. The composition of claim 15 wherein said detergent builder comprises a zeolite.

18. The composition of claim 15 wherein said detergent builder comprises an alkali metal citrate.

19. The composition of claim 15 wherein said detergent builder comprises an alkali metal carbonate.

20. The composition of claim 15 wherein said detergent builder is an alkali metal silicate.

21. A process for preparing a concentrated granular detergent composition containing about 15 wt % water or less comprising:

a) forming a crutcher slurry by mixing at least one organic surfactant, at least one detergent builder, water and a deflocculating polymer containing polymer chains of the structure P-QR, wherein P represents a polymer chain segment of a hydrophilic polymer and QR represents a hydrophobic end-cap group wherein R is an organic hydrophobic radical containing from about 4 to 28 carbon atoms, and Q is S; said crutcher slurry comprising lamellar droplets of said surfactant dispersed in the aqueous phase and having a viscosity in the range of from about 2,000 to 500,000 cps; and b) subjecting said slurry to spray dry conditions to produce a granulated detergent composition having a water content of about 15% by weight or less and a content of deflocculating polymer in the range of from about 0.01 to about 7.5% by weight.

22. The process of claim 21 wherein said slurry contains from about 15 to 50% by weight of surfactant.

23. The process of claim 21 wherein said slurry has a viscosity in the range of about 100,000 to 500,000 cps.

24. The process of claim 23 wherein said viscosity is in the range of about 200,000 to 400,000 cps.

25. The process of claim 21 wherein said slurry has a solids content in the range of about 35 to 65% by weight.

26. The process of claim 25 wherein said solids content is in the range of about 50 to 65% by weight.

27. The process of claim 21 wherein the hydrophilic polymer chain segment P is polyacrylic or polymethacrylic acid.

28. The process of claim 21 wherein said hydrophilic polymer chain segment P is a copolymer containing at least 50% by weight of polymerized acrylic or methacrylic acid and less than 50% by weight of polymerized maleic acid or maleic anhydride.

29. The process of claim 21 wherein said polymer has a weight average molecular weight in the range of from about 2,000 to 25,000.

30. The process of claim 29 wherein said polymer has a weight average molecular weight in the range of from about 3,000 to 10,000.

31. The process of claim 21 wherein from about 25 to 95% by weight of the hydrophilic polymer chains present in said deflocculating polymer have the structure P-SR.

32. The process of claim 31 wherein R is an alkyl group containing from about 6 to 18 carbon atoms.

33. The process of claim 32 wherein R is dodecyl.

* * * * *